US011653767B1

(12) United States Patent
Jackson et al.

(10) Patent No.: US 11,653,767 B1
(45) Date of Patent: May 23, 2023

(54) SEATBACK ASSEMBLY ATTACHABLE TO A WALL

(71) Applicants: Lee Michael Jackson, Cheshire, CT (US); Richard Willis Jackson, Wilmington, DE (US)

(72) Inventors: Lee Michael Jackson, Cheshire, CT (US); Richard Willis Jackson, Wilmington, DE (US)

( * ) Notice: Subject to any disclaimer, the term of this patent is extended or adjusted under 35 U.S.C. 154(b) by 0 days.

(21) Appl. No.: 17/741,322

(22) Filed: May 10, 2022

Related U.S. Application Data

(60) Provisional application No. 63/187,091, filed on May 11, 2021.

(51) Int. Cl.
*A47C 1/12* (2006.01)
*A47C 11/00* (2006.01)
*A47C 7/40* (2006.01)

(52) U.S. Cl.
CPC ..... *A47C 11/00* (2013.01); *A47C 7/40* (2013.01)

(58) Field of Classification Search
CPC ..... A47C 11/00; A47C 17/40
USPC ..... 297/130.1, 230.12, 230.14, 440.15, 297/440.16, 230.1; 52/7, 27, 8
See application file for complete search history.

(56) References Cited

U.S. PATENT DOCUMENTS 1,752,734 A * 4/1930 Duke ..... A47C 11/00 108/154
2,171,374 A * 8/1939 Ryan ..... E04H 3/12 52/8 X
2,554,779 A * 5/1951 Goodwin ..... E04D 3/405 52/95
3,697,129 A * 10/1972 Sklaar ..... A47C 11/00 297/182
4,032,188 A * 6/1977 Jones ..... A47C 11/00 297/440.13
4,229,919 A * 10/1980 Hughes ..... A47C 11/00 52/741.1
4,285,542 A * 8/1981 Boisvert ..... A47C 11/00 52/8 X
5,337,471 A * 8/1994 Graney ..... A47C 15/004 52/8 X (Continued)

FOREIGN PATENT DOCUMENTS

DE 102004053371 A1 * 5/2006 ..... A47C 1/16
EP 3053483 A1 * 8/2016 ..... A47C 11/00

(Continued)

*Primary Examiner* — Rodney B White
(74) *Attorney, Agent, or Firm* — Malloy & Malloy PL

(57) ABSTRACT

A seatback assembly structured to at least partially support a seated individual on a wall, specifically but not exclusively, a pre-existing or newly constructed wall configured to facilitate one or more individuals to sit on an exposed portion thereof. The seatback assembly includes a back support orientation to and extending along the length of the wall and a connector assembly disposed in an operative position interconnecting the back support to the wall. The connector assembly includes at least one or a plurality of brackets, each including a base and a support segment and an anchor interconnecting each of the one or more brackets at least partially on the interior of and in stabilizing relation to the wall. A supporting orientation of the back support includes it connected to the wall in receiving, engageable relation to a seated individual.

14 Claims, 4 Drawing Sheets

(56) References Cited

U.S. PATENT DOCUMENTS 6,296,315 B1 * 10/2001 Jensen ..... A47C 1/121 52/8 X
6,616,234 B1 * 9/2003 King ..... A47C 17/16 297/440.16
6,752,465 B2 * 6/2004 Igarashi ..... B60N 2/242 297/440.15
6,994,398 B2 * 2/2006 Gross ..... A47C 4/02 52/8 X
7,131,699 B2 * 11/2006 Mulmed ..... A47C 11/00 297/440.14
7,267,403 B2 * 9/2007 Conner ..... A47C 1/12 52/8 X
7,386,922 B1 * 6/2008 Taylor ..... E04D 13/10 52/27
7,905,546 B2 * 3/2011 Conner ..... A47C 7/407 52/8 X
7,931,339 B1 * 4/2011 Stocker ..... A47C 7/0213 297/440.15 X
8,056,974 B2 * 11/2011 Conner ..... A47C 1/12 52/8 X
8,282,171 B1 * 10/2012 Stocker ..... A47C 7/0213 297/440.15 X
8,459,738 B2 * 6/2013 Downey ..... A47C 7/42 297/230.12 X
8,627,523 B2 * 1/2014 Kaiser ..... A47C 19/022 297/230.1 X
8,764,114 B1 * 7/2014 Frank ..... A47C 7/42 297/440.16
8,869,461 B1 * 10/2014 Ferry ..... E04H 3/12 52/8 X
2005/0235578 A1 * 10/2005 Heidler, Jr. ..... E04D 3/405 52/58
2011/0029123 A1 * 2/2011 Olarte ..... G06Q 10/0875 705/500
2022/0061538 A1 * 3/2022 Altshuler ..... A47C 11/00

FOREIGN PATENT DOCUMENTS

JP 3146968 U * 12/2008 ..... A47C 11/00
KR 2018027097 A * 3/2018 ..... A47B 13/02
KR 1895269 B1 * 9/2018 ..... A47C 1/121

* cited by examiner

FIG. 3
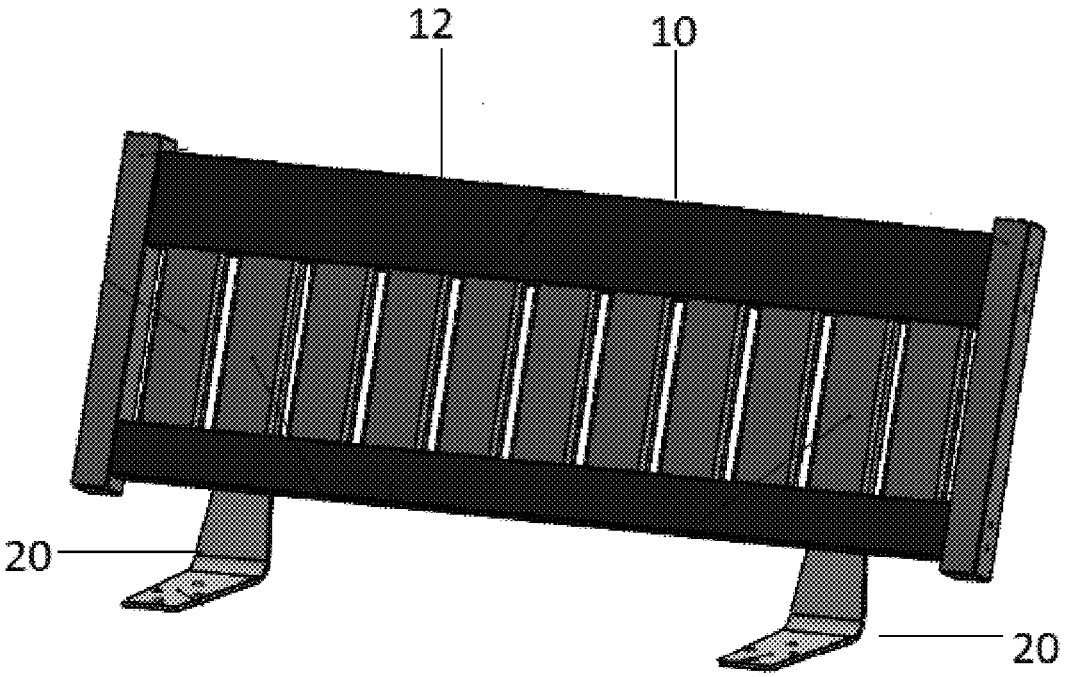
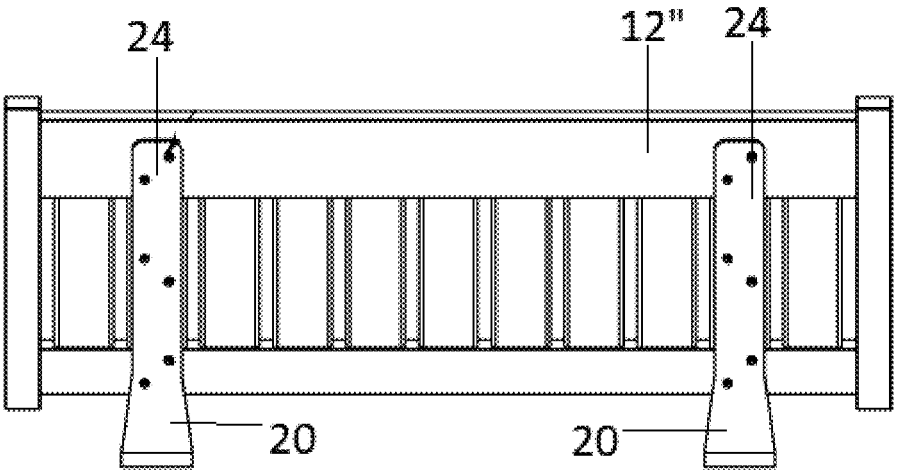
FIG. 4

SEATBACK ASSEMBLY ATTACHABLE TO A WALL

CLAIM OF PRIORITY

The present application is based on, and a claim of priority is made under 35 U.S.C. Section 119(e) to a provisional patent application that is currently in the U.S. Patent and Trademark Office, namely, that having Ser. No. 63/187,091, and a filing date of May 11, 2021, and which is incorporated herein by reference.

BACKGROUND OF THE INVENTION

Field of the Invention

This invention is directed to seatback assembly attachable to a wall, including newly built or installed walls as well as pre-existing walls, The seatback assembly is structurally configured to facilitate seating of one or more individuals on an exposed portion of the wall on which it is mounted.

Description of the Related Art

The presence of walls is ubiquitous in domestic environments, such as in walls surrounding or bordering a domestic dwelling. Similarly, the building of various types of wall structures for placement and utilization in public gathering areas such as parks or the like is equally if not more common. While the structural and dimensional parameters of these different types of walls may vary significantly, it is also quite common for the upper or outer exposed level and/or surface being configured to allow or facilitate the support of one or more individuals in a seated orientation. In the outdoor living industry dedicated to the supply of different types of structures for outdoor utilization and use, such wall types may be colloquially referred to as "seat walls".

While such seat walls may not be purposely designed to serve as seats for individuals, their common structural configuration and dimensioning facilitate such activity. However, since the majority of such domestically and publicly available wall structures are not normally structured to purposely serve as seating areas or structures, such available wall structures are absent any type of supplementary support such as a back support, backrest, etc.

Accordingly, there is a need in the area of outdoor living to enhance the utilization of such "seat walls" by including a seatback assembly which is structured to be connected and/or mounted in a stabilized manner to pre-existing or newly constructed walls. Such a preferred and proposed seatback assembly, while initially being considered as an accessory, is preferably structured to serve as a permanent fixture on pre-existing or newly constructed walls and enjoy an extended operable life, which may be equal to the operable life of the wall to which such seatback assemblies are mounted.

Further, such a preferred and proposed seatback assembly should be securable to a pre-existing or newly constructed wall regardless of the material from which the wall is formed. By way of example a proposed seatback assembly should be capable of being easily installed in walls formed of a stone, brick, cement his material, etc. However, the structural versatility of a preferred and proposed seatback assembly should not be limited to utilization of such material construction. To the contrary, the structural and operative features of a proposed and preferred seatback assembly should be capable of being attached to walls formed of other materials including, but not limited to wood, where in wooden walls are also well known in both domestic and public environments.

SUMMARY OF THE INVENTION

The present invention is directed to a seatback assembly structured for a variety of different applications in the outdoor living industry specifically including, but not limited to, the mounting thereof on a pre-existing or newly constructed wall structurally adapted to allow and/or facilitate one or more individuals to be seated on an exposed, generally horizontal surface of an upper portion or top level of the wall. Such wall structures may be known as "seat walls".

In addition, the structural and operative features of the seatback assembly of the present invention enable it to be operatively attached to a pre-existing or newly constructed wall structure made of stone, brick, concrete blocks or manufactured concrete, or like material commonly found in both domestic and public environments. However, it is emphasized herein that the structural and operative features of the seatback assembly, as explained in greater detail hereinafter, are not limited to the use of the seatback assembly on walls made of stone, brick, manufactured concrete, etc. To the contrary, the structural features of the seatback assembly are such as to efficiently and securely attach and/or mount it to a variety of different wall type structures, capable of supporting one or more individuals in a seated orientation. By way of example such different wall structures may be formed in whole or in part from other materials including wood, plastics, synthetics, etc.

In more specific terms, the seatback assembly of the present invention includes a back support having a predetermined length which may vary according to the number of individuals seated on a wall to which the seatback assembly is attached. A connector assembly is attached to the wall in an operative position and is structured to interconnect the back support to the wall in a supporting orientation. When in the supporting orientation the back support is disposed in receiving, confronting relation to generally the rear or back portion of the one or more seated individuals.

The supporting orientation of the back support further includes it being disposed in substantially aligned relation to a rear exposed periphery of the wall and more specifically to a rear periphery of an exposed surface of the wall on which the one or more individuals sit. Further, such a substantially aligned relation of the back support may include it being spaced upwardly and/or outwardly from exposed supporting surface in at least minimally spaced relation thereto. To the contrary, the lower longitudinal edge or periphery of the back support itself may be disposed in immediately adjacent and/or in contiguous relation to the noted exterior rear periphery of the supporting surface of the wall to which the back support is attached.

In addition, the aforementioned supporting orientation of the back support may include it being disposed at a predetermined outwardly extending angular relation to the supporting surface on which the one or more individuals are positioned. Such predetermined angular orientation may be a substantially perpendicular relation to the supporting surface or perhaps preferably and more practically at an inclined relation to the normally horizontal orientation of the supporting, sitting surface. Such inclined or angular relation may of course vary depending on the overall dimensions of the wall itself as well as other factors. When angularly oriented, the incline may be generally in the range of between 20°-30° from a perpendicular orientation of the back support.

As explained in greater detail hereinafter, the aforementioned and described supporting orientation of the back support is accomplished, at least in part due to the structural and operative features of the connecting assembly which interconnects the back support to the wall in an appropriate manner. Accordingly, the connector assembly comprises at least one bracket including a base and a support segment. The support segment is integrally or fixedly connected to the base preferably at one outer end thereof. Accordingly, the cooperative structuring between the base and support segment is such as to dispose the back support in the intended and preferred operative position. As indicated, the operative position includes, but is not limited to, arranging the back support in the aforementioned predetermined angular and/or inclined relation to the individual supporting surface of the wall to which the back support is attached. Therefore, the integrally and or fixedly attached support segment extends outward from the base and or the outer peripheral end thereof at an angle which is predetermined to engage the back support in supporting relation thereto. As a result, the back support will be disposed relative to the supporting surface of the wall at the aforementioned predetermined angle (perpendicular or obtuse).

As noted, the seatback assembly of the present invention is specifically, but not exclusively, structured to be mounted on and/or connected to a pre-existing or newly constructed wall of the type described herein. As such, the seatback assembly of the present invention may be initially or somewhat generally considered to be an "accessory" for use in the outdoor living industry. However, it is further emphasized that the seatback assembly is structured to define a permanent component which is intended to have a long operable life, which may correspond to the life of the wall on which it is mounted. Therefore, in order to establish such a fixed, reliable and stabilized supporting attachment of the back support to the wall, the aforementioned connector assembly further includes an anchor preferably in the form of an elongated structural pin. Moreover, the anchor or structural pin is formed of steel, including stainless steel, or other high-strength material having sufficient structural integrity to effectively maintain the intended connection of the back support to the wall for an extended operational life.

Such stabilization is accomplished by the structuring and dimensioning of the structural pin to be cooperatively connected to the bracket in a manner which maintains the intended stabilized attachment of the support bracket to the wall in the described operative position. Therefore, the aforementioned operative position of the connector assembly further comprises the anchor being connected to the base of the at least one bracket and extending downwardly therefrom into an interior of the wall. Stabilization is further facilitated by forming the structural pin of the anchor from a high-strength material such as steel, including stainless steel, as set forth above and also sufficiently dimensioning the structural pin to maintain a stabilized supporting orientation of the back support. Therefore, in at least one embodiment to be described in greater detail hereinafter, the structural pin may have a length of generally about 10 inches and a diameter of generally about ½ inch.

Also, in one in more embodiments of the present invention the operative position of the connecting assembly may be further defined as the anchor or structural pin being connected generally at one end thereof to the base on the interior of the wall. Therefore, in one or more embodiments, the entirety of the pin as well as at least a majority of the base of the at least one anchor is disposed within the interior of the wall in a nonexposed position. Such interior disposition of the base and the anchor or elongated structural pin not only provides sufficient stability in maintaining the back support in the supporting orientation, as described above but will also eliminate any potentially damaging or uncomfortable protrusions or interruptions in the supporting surface of the wall on which the one or more individuals may set. Disposition, installation and interconnection of the base of the bracket with the anchor or elongated structural pin may be accomplished by core drilling through portions of the wall. In the alternative, other appropriate installation and/or interconnection procedures may be utilized, using a variety of different common tooling.

As set forth above depending upon the configuration and dimension of the back support, as well as the intention to at least partially support one individual or a plurality of individuals on a common seating surface of the wall, the connector assembly may include a plurality of brackets. When so utilized, the plurality of brackets are disposed in spaced relation to one another along the length or longitudinal dimension of the back support. In addition, and as indicated the connector assembly of the present invention includes each of the plurality of brackets being operatively associated with and connected to an anchor. In the multi-bracket embodiment, each of a plurality of anchors comprises or is at least partially defined by an elongated structural pin. As described above, each structural pin is connected to the base of a different one of the plurality of brackets on an interior of the wall. Such interior disposition comprises one end or one portion of the pin possibly including a head secured to the base of the corresponding bracket on the interior of the wall.

Further, at least the majority of a portion of the base of each of the brackets is disposed on the interior of the wall in connected, stabilizing engagement with corresponding ones of the plurality of anchors or structural pins. Such operative position of the connector assembly is thereby further defined by at least a majority of the base and an entirety of the anchor or structural pin associated therewith, being disposed within the interior of the wall. Further each of the structural pins may be formed of a high-strength material such as, but not limited to steel, including stainless steel, and be sufficiently dimensioned to provide the stability and disposing in maintaining the support back in the supporting orientation relative to the seating surface on which the one or more individuals may be supported.

As with the embodiment of the seatback assembly of the present invention comprising the connector assembly comprising a single or at least one bracket, one or more embodiments comprising a plurality of brackets further include each bracket including the aforementioned base and a support segment integrally or fixedly connected thereto and extending outwardly therefrom at a predetermined angular orientation.

In order to further increase the attractiveness and thereby enhance commercial demand for the seatback assembly of the present invention other features may be added. Such additional features may include one or more armrests located at opposite ends of the back support or in spaced relation to one another along the length of the back support and overlying communicating relation with the seating surface of the wall. In addition, a canopy or like overhead covering can be operatively connected to the back support, and or other portions of the seatback assembly in order to provide protection against environmental weather conditions such as sun, rain, etc.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 3 is a perspective view of the seatback assembly of the embodiment of FIG. 1 assembled but not connected to a wall.

FIG. 4 is a rear view of the embodiment of FIG. 3.

Like reference numerals refer to like parts throughout the several views of the drawings.

DETAILED DESCRIPTION OF THE PREFERRED EMBODIMENT

Figure 1:
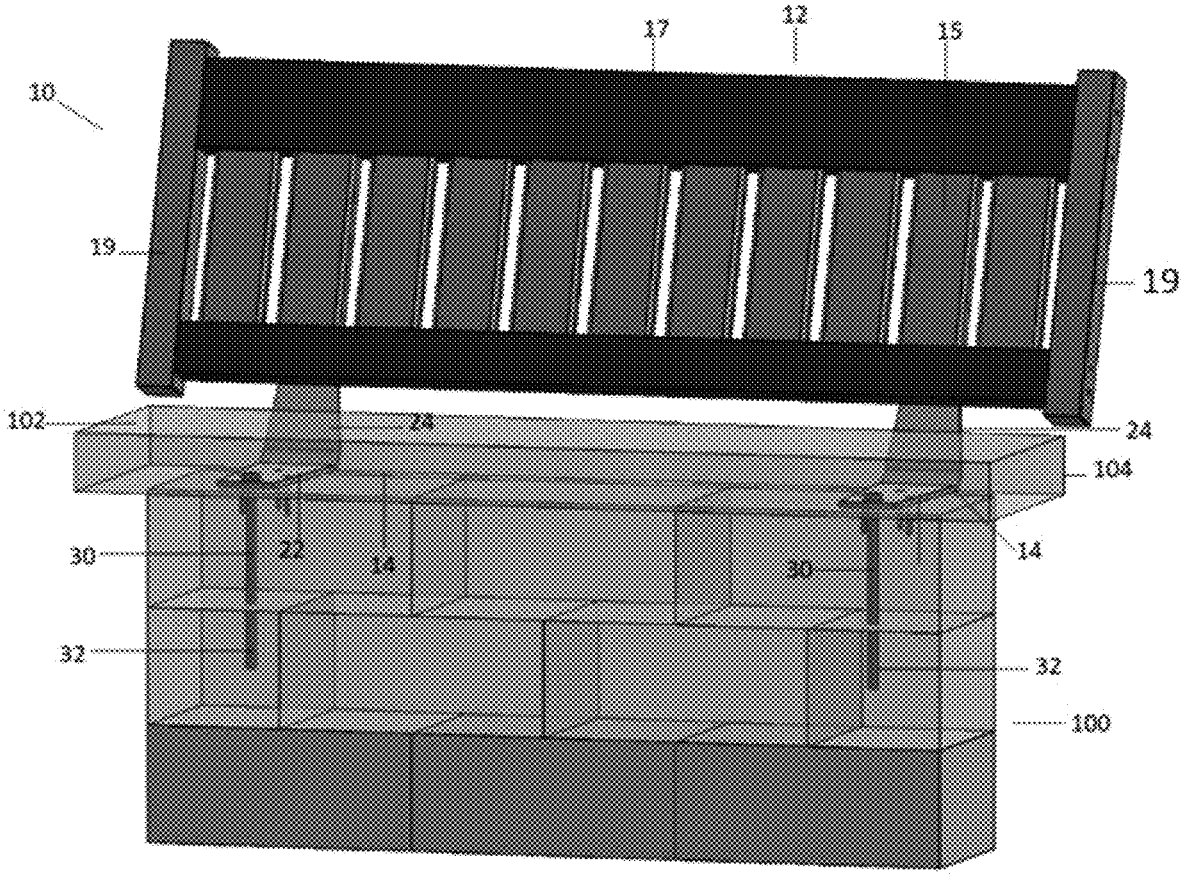
FIG. 1 is a perspective view of the seatback assembly of the present invention connected in a supporting orientation on a wall of the type structurally configured to facilitate individuals being seated thereon.

The invention now will be described more fully hereinafter with reference to the accompanying drawings in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention is directed to a seatback assembly generally indicated his 10 structured for a variety of different applications in the outdoor living industry specifically including, but not limited to, the mounting thereof on a pre-existing or newly constructed wall 100. As represented throughout the Figures, the wall 100 is structurally adapted to allow and/or facilitate one or more individuals (not shown) to be seated on an exposed, generally horizontal surface 102 of an upper portion or top level 104 of the wall 100. In the outdoor living industry, this type or category of wall structure may be known as a "seat wall".

In addition, the structural and operative features of the seatback assembly 10 enable it to be operatively attached to the pre-existing or newly constructed wall structure 100 made of stone, brick, concrete blocks or manufactured concrete, or like material commonly found in both domestic, home environments and/or public gathering areas. However, it is emphasized herein that the structural and operative features of the seatback assembly 10, as explained in greater detail hereinafter, are not limited to the use of the seatback assembly 10 on walls or "seat walls" made of stone, brick, manufactured concrete, etc. To the contrary, the structural features of the seatback assembly 10 are such as to efficiently and securely attach and/or mount it to a variety of different wall type structures, capable of supporting one or more individuals in a seated orientation. By way of example, such different wall structures may be formed in whole or in part from other materials including wood, plastics, synthetics, etc.

Figure 2:
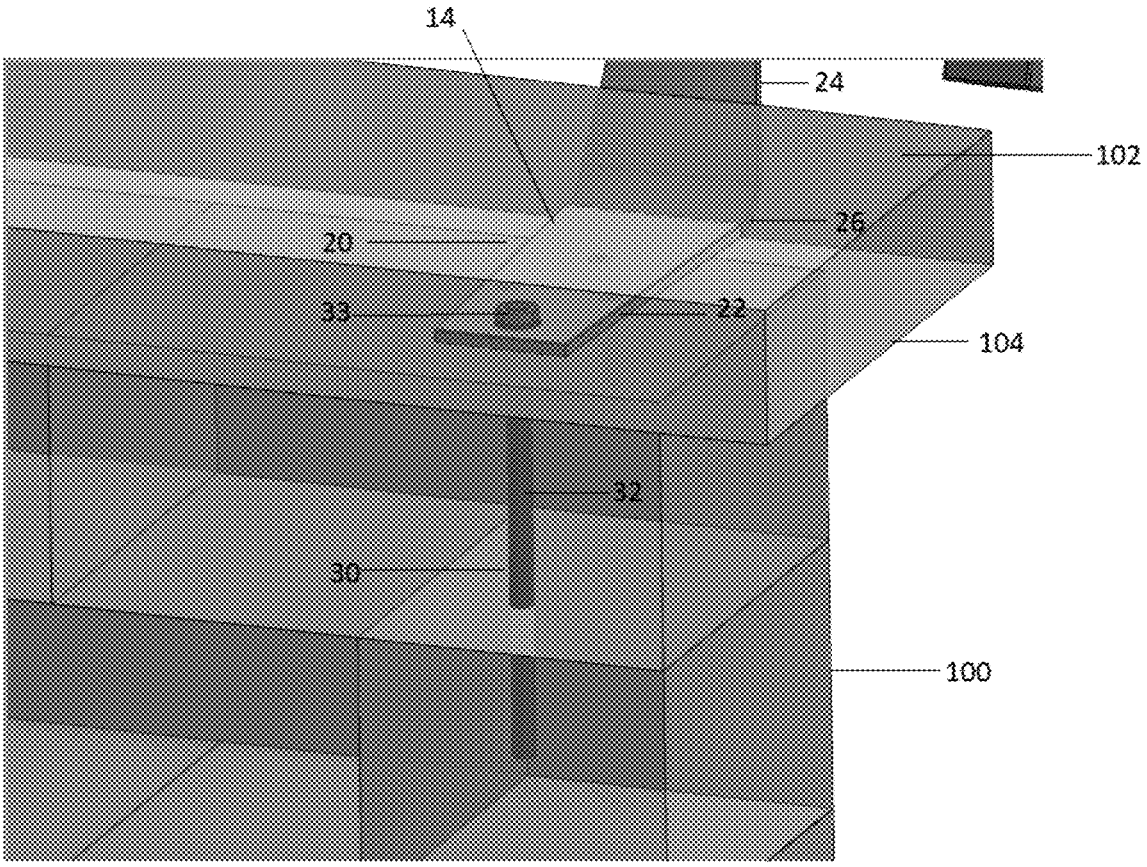
FIG. 2 is a detailed view in partial cutaway of a connector assembly of the present invention.

It is to be noted that the representation of the wall 100 in FIGS. 1 and 2 is "transparent", for purposes of clarity. However, it is recognized that in a real-life application the wall 100 we rarely if ever be formed of a material which is transparent or translucent, but rather a generally stronger and more common material type such as set forth in more detail herein.

The seatback assembly 10 of the present invention includes a back support, generally indicated is 12, having a predetermined length or longitudinal dimension which may vary according to the number of individuals intended to be seated on the wall 100 to which the seatback assembly 10 is mounted. Moreover, a connector assembly, generally indicated is 14, is attached to the wall 100 in an operative position, as represented in at least FIGS. 1 and 2. As represented, the connector assembly 14 is structured to interconnect the back support 12 to the wall 100 in an intended supporting orientation, as represented throughout the Figures. When in the represented supporting orientation, the back support 12 is disposed in receiving, confronting relation to generally the rear or back portion of the one or more seated individuals (not shown for purposes of clarity).

As also represented throughout the Figures, the back support 12 is disclosed as having a generally "slatted" construction comprising a plurality of spaced apart, substantially vertically oriented slats 15 extending along the length or longitudinal dimension of the back support 12. As also represented the plurality of slats 15 are interconnected to substantially horizontally disposed frame member 17 as well as end supports 19. However, it is emphasized that the structural composition and/or components from which the back support 12 is formed may vary significantly from the represented slatted construction to a solid structure. In addition, the seat back 12 may have an at least partially curved configuration, rather than a substantially planar configuration. Further, a radius of such a curved configuration of the back support 12 may be varied to accommodate any size, shape or orientation of a newly constructed or pre-existing "seat wall" on which it is mounted, regardless of the back support 12 having a slatted or solid construction as discussed above. Therefore, the style of the seatback 12 is not limited to any structural design. Also, the material from which the back support 12 is formed may also vary, wherein such material will include sufficient structural integrity to provide proper support to the one or more individuals seated on the surface 102.

The supporting orientation of the back support 12 further includes it being disposed in substantially aligned relation to a rear exposed periphery 106 of the wall 100, which may be defined by the rear periphery of the exposed seating surface 102 of the wall 100 on which the one or more individuals may be supported. Further, such a substantially aligned relation of the back support 12 may include the lower longitudinal edge 12' being spaced upwardly and/or outwardly from exposed supporting surface 102, as clearly represented in FIG. 1. To the contrary, the lower longitudinal edge or periphery 12' of the back support 12 may be disposed in immediately adjacent and/or in contiguous relation to the exterior rear periphery 106 of the supporting surface 102 of the wall 100 to which the back support 12 is attached.

In addition, the aforementioned supporting orientation of the back support 12 may include it being disposed at a predetermined outwardly extending inclined or angular relation to the supporting surface 102. However, such predetermined angular orientation may also be a substantially perpendicular to the supporting surface 102 (not shown) or perhaps preferably and more practically at an inclined relation to the normally horizontal orientation of the supporting, sitting surface 102, as represented in FIGS. 1 and 3. Such inclined or angular relation may of course vary depending on the overall dimensions of the wall 100 as well as other factors. When angularly oriented, the represented "rearward" incline may be generally in the range of between 20°-30° from a perpendicular orientation of the back support 12 relative to the supported seating surface 102. By way of non-limiting example, a preferred rearward incline of the back support 12 may be 110 degrees from horizontal, which would be equivalent to 20 degrees from a perpendicular orientation.

Figure 5:
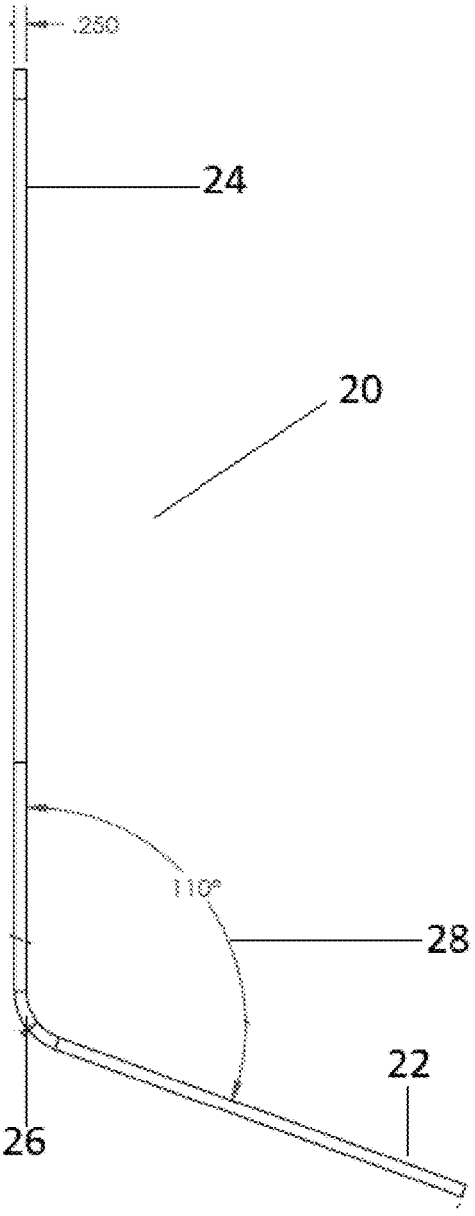
FIG. 5 is a detail side view of a bracket of the connector assembly of the embodiment of FIGS. 1-4.
Figure 6:
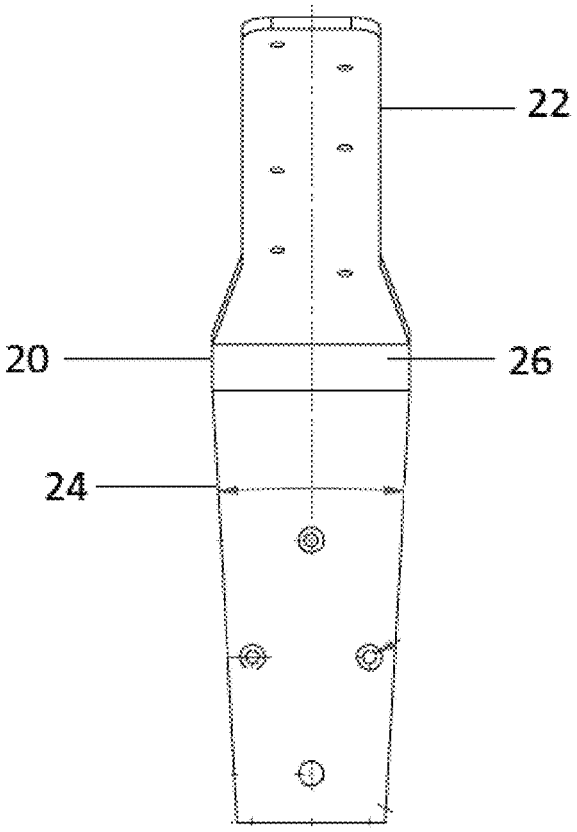
FIG. 6 is a front view of the bracket of the embodiment of FIG. 5.

As explained in greater detail hereinafter, the aforementioned and described supporting orientation of the back support 12 is accomplished, at least in its part due to the structural and operative features of the connecting assembly 14 which interconnects the back support 12 to the wall 100 in an appropriate manner. Accordingly, the connector assembly 14 comprises at least one bracket 20, represented in detail in FIGS. 5 and 6. The at least one bracket 20 includes at least one portion or base 22 and one other portion or support segment 24. The support segment 24 is integrally or fixedly connected to the base 22 preferably at a junction 26 disposed at one outer end of the base 20, as clearly represented in FIG. 5. Accordingly, the cooperative structuring between the base 22 and support segment 24 is such as to dispose the back support 12 in the intended and preferred operative position. As indicated, the operative position includes, but is not limited to, disposing the back support 12 in the aforementioned predetermined angular and/or inclined relation to the supporting surface 102 of the wall 100. Therefore, the integrally and or fixedly attached support segment 24 extends outward from the base 22 at a preferred and/or predetermined angle 28, as represented in FIG. 5. The angle 28 between the base 22 and the support segment 24 is predetermined to dispose the back support 12 in the aforementioned predetermined and preferred angular or inclined orientation relative to support surface 102. Further, as represented in FIG. 4 the one other portion or support segment 24 may be attached using at least one or a plurality of connectors, to the rear surface 12" of the back support 12. As a result, the back support will be disposed relative to the supporting surface of the wall at the aforementioned predetermined, preferably obtuse angle to the support surface 102.

As noted, the seatback assembly 10 of the present invention is specifically, but not exclusively, structured to be mounted on and/or connected to a pre-existing or newly constructed wall 100 of the type described herein. As such, the seatback assembly 10 may be initially or somewhat generally considered to be an "accessory" for use in the outdoor living industry. However, it is further emphasized that the seatback assembly 10 is structured to define a permanent cooperative component with the wall 100 and is intended to have a long operable life, which may correspond to the life of the wall 100 on which it is mounted. Therefore, in order to establish such a fixed, reliable and stabilized supporting attachment of the back support 12 to the wall 100, the aforementioned connector assembly further includes an anchor, generally indicated as 30, preferably in the form of an elongated structural pin 32, as represented in detail in FIG. 2. Moreover, the anchor 30 and/or structural pin 32 is preferably formed of steel, including stainless steel, or alternatively of other high-strength material having sufficient structural integrity to effectively maintain the intended connection of the back support 12 to the wall 100 for the aforementioned extended operational life.

Such a stabilized connection and/or mounting is at least partially accomplished by the structuring and dimensioning of the structural pin 32 to be cooperatively connected to the bracket 20 in a manner which maintains the intended stabilized attachment of the connector assembly 14 to the wall 100 in the described operative position, as clearly represented in FIGS. 1 and 2. Therefore, the aforementioned operative position of the connector assembly 14 further comprises the structural pin 32 being connected to the base 22 of the at least one bracket 20 and extend downwardly therefrom into an interior of the wall 100. Stabilization is further facilitated by forming the structural pin 32 of the anchor 30 from the aforementioned high-strength material such as steel, including stainless steel, as set forth above. Stabilization is further facilitated by the sufficient dimensioning of the structural pin 32 to further assure maintenance of a stabilized supporting orientation of the back support 12. Therefore, in at least one embodiment to be described in greater detail hereinafter, the structural pin 32 may have a length of generally about 10 inches and a diameter of generally about ½ inch.

While not represented in detail throughout the figures the connector assembly may also include a plurality of appropriately structured connectors such as screws, bolts, etc. capable being applied to hard material including the types of material set forth herein such as stone, brick, cement, etc. Such plurality of connectors may be secured to the base and extend therethrough into attachment with correspondingly disposed interior portions of the wall 100. Appropriate structuring of the base 22 including one or more openings or apertures for the fitting placement of the plurality of connectors may also be provided.

Also, in one in more embodiments of the present invention the operative position of the connecting assembly 14 may be further defined as the anchor 30 or structural pin 32 being connected generally at one end thereof to the base 22 on the interior of the wall 100. Therefore, in one or more embodiments, the entirety of the pin 32 as well as at least a majority of the base 22 of the at least one anchor 30 is disposed within the interior of the wall in a nonexposed position, again as clearly represented in FIGS. 1 and 2. Such interior disposition of the base 22 and the anchor 30 or elongated structural pin 32 not only provides sufficient stability in maintaining the back support 12 in the supporting orientation, as described above, but will also eliminate any potentially damaging or uncomfortable protrusions or interruptions in the supporting surface 102 on which the one or more individuals may sit. Disposition, installation and interconnection of the base 22 of the bracket 20 with the structural pin 32 may be accomplished by core drilling through appropriate portions of the wall 100. In the alternative, other appropriate installation and/or interconnection procedures may be utilized, using a variety of different common tooling.

As set forth above, depending upon the configuration and dimension of the back support 12, as well as the intention to at least partially support one individual or a plurality of individuals on a common seating surface 102 of the wall 100, the connector assembly 14 may include a plurality of brackets, each indicated as 20. When so utilized, each of the plurality of brackets 20 is disposed in spaced relation to one another along the length or longitudinal dimension of the back support 12. In addition, and as indicated the connector assembly 14 of the present invention includes each of the plurality of brackets 20 being operatively associated with and connected to an anchor 30. In the multi-bracket embodiment, each of a plurality of anchors 30 comprises or is at least partially defined by an elongated structural pin 32. As described above, each structural pin 32 is connected to the base 22 of a different one of the plurality of brackets 20 on an interior of the wall 100 is clearly represented in FIGS. 1 and 2. Such interior disposition comprises one end or one portion of the pin 32 possibly including a head 33 secured to the base 22 of the corresponding bracket on the interior of the wall 100.

Further, at least the majority of a portion of the base 22 of each of the brackets 20 is disposed on the interior of the wall 100 in connected, stabilizing engagement with corresponding ones of the plurality of anchors 30 and structural pins 32. Such operative position of the connector assembly 14 is thereby further defined by at least a majority of a portion of the base 22 and an entirety of the structural pin 32 of anchor 30, being disposed within the interior of the wall. Further each of the structural pins 32 may be formed of a high-strength material such as, but not limited to steel, including stainless steel, and be sufficiently dimensioned to provide the stability of the support back 12 in the supporting orientation relative to the seating surface 102 on which the one or more individuals may be supported.

As with the embodiment of the seatback assembly of the present invention comprising the connector assembly 14 comprising a single or at least one bracket 20, one or more embodiments comprising a plurality of brackets 20 further include each bracket 20 including the aforementioned base 22 and a support segment 24 integrally or fixedly connected thereto and extending outwardly therefrom at a predetermined angular orientation 28 (see FIG. 5).

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A seatback assembly for at least partially supporting a seated individual on a wall comprising:

a back support including a predetermined length extending along the length of the wall, a connector assembly comprising at least one bracket and an anchor; said anchor disposed in interconnecting, stabilizing relation between said at least one bracket and an interior of the wall, said connector assembly attached to the wall in an operative position and interconnecting said back support to the wall in a supporting orientation, said supporting orientation comprising said back support disposed in receiving, confronting relation to at least a back of the seated individual, said operative position of said connector assembly comprising said anchor and at least one portion of said at least one bracket disposed on an interior of the wall, substantially beneath an exposed top level of the wall, and said operative position of said connector assembly further comprising said anchor connected to said at least one portion of said at least one bracket on an interior of the wall; an entirety of a remainder of said anchor extending downward from said at least one portion into an interior of the wall.

2. The seatback assembly as recited in claim 1 wherein said supporting orientation further comprises said back support disposed in the substantially aligned relation to a rear exposed periphery of the wall.

3. The seatback assembly as recited in claim 2 wherein said supporting orientation further comprises said predetermined length disposed along the length of the rear exposed periphery of the wall.

4. The seatback assembly as recited in claim 3 wherein said predetermined length of said back support is sufficient to support a plurality of seated individuals concurrent to said supporting orientation of said back support.

5. The seatback assembly as recited in claim 1 wherein said connector assembly comprises at least one bracket including a base and a support segment; said support segment fixedly connected to one end of said base and extending outward, at a predetermined angle therefrom.

6. The seatback assembly as recited in claim 5 wherein said connector assembly further comprises an elongated anchor connected to said base; said operative position of said connector assembly comprising said anchor extending outwardly from said base into an interior of the wall.

7. The seatback assembly as recited in claim 6 wherein said anchor comprises a pin having a predetermined length, said pin including one end connected to said base and a remainder of said predetermined length extending downward from said base into an interior of the wall.

8. The seatback assembly as recited in claim 7 wherein said operative position of said connector assembly comprises said base and an entirety of said pin disposed within an interior of the wall, substantially below an exposed top level of the wall.

9. The seatback assembly as recited in claim 7 wherein said predetermined length of said pin is substantially about 10 inches; said operative position further comprising said anchor having one end secured to said base and said base and an entirety of said predetermined length of said anchor disposed into an interior of the wall.

10. The seatback assembly as recited in claim 1 wherein said connector assembly comprises a plurality of brackets extending in spaced relation to one another along said predetermined length of said back support in interconnecting relation between said back support and the wall.

11. The seatback assembly as recited in claim 10 wherein said connector assembly further comprises a plurality of anchors each connected to a different one of said plurality of brackets in attached, stabilizing relation to the wall.

12. The seatback assembly as recited in claim 11 wherein said operative position of said connector assembly comprises at least a base of each of said plurality of brackets disposed within an interior of the wall, substantially below an exposed top level of the wall.

13. The seatback assembly as recited in claim 12 wherein said operative position of said connector assembly further comprises each of said plurality of anchors secured, on an interior of the wall, to said base of a different one of said plurality of brackets; said bases of said plurality of brackets and corresponding ones of said anchors connected thereto disposed in their entirety on the interior of the wall.

14. A seatback assembly for at least partially supporting a seated individual on a wall comprising:

a back support attached to and extending along the length of the wall, a connector assembly disposed in an operative position interconnecting said back support to the wall;

said connector assembly including a bracket comprising a base and a support segment, said operative position of said connector assembly comprising said anchor connecting said base in stabilizing relation to the wall within an interior of the wall, said supporting orientation comprising said back support disposed in receiving, engageable relation to the at least one seated individual, said anchor comprising an elongated pin connected to said base, said operative position further comprising said base and an entirety of said pin disposed on an interior of the wall in supporting, stabilizing relation to said support segment, and said operative position of said connector assembly further comprising said base disposed within the wall, substantially below an exposed top level of the wall and said support segment fixedly connected to said base extending outwardly from the wall in supporting attachment to said back support.

* * * * *